United States Patent [19]

Huang

[11] Patent Number: 4,899,448

[45] Date of Patent: Feb. 13, 1990

[54] BASIC FORMULA FOR ACTIVE SKETCH PATTERN DRAWING IN UPPER BODY TAILORING

[76] Inventor: Ding S. Huang, 5th Floor, No. 9-16, Lane 344, Nanking W. Road, Taipei, Taiwan

[21] Appl. No.: 194,319

[22] Filed: May 16, 1988

[51] Int. Cl.[4] ..... A41H 3/00

[52] U.S. Cl. ..... 33/17 R; 33/12

[58] Field of Search ..... 33/17 R, 17 A, 11, 12

[56] References Cited

U.S. PATENT DOCUMENTS

| | | | |
|---|---|---|---|
| 389,287 | 9/1888 | Christner | 33/17 R |
| 411,686 | 9/1889 | Schubert | 33/17 R |
| 927,845 | 7/1909 | Evangelista | 33/17 R |
| 959,972 | 5/1910 | Tomaselli | 33/11 |
| 1,278,663 | 9/1918 | Kramer | 33/12 |
| 1,397,302 | 11/1921 | Tarasoff | 33/17 R |
| 1,612,544 | 12/1926 | Spalding | 33/17 R |
| 1,624,894 | 4/1927 | Mongelli | 33/17 R |
| 1,884,494 | 10/1932 | Zorn | 33/17 R |
| 2,297,439 | 9/1942 | Szabo | 33/17 R |
| 4,542,586 | 9/1985 | Hori | 33/17 R |

FOREIGN PATENT DOCUMENTS

| | | | |
|---|---|---|---|
| 0480758 | 2/1928 | Fed. Rep. of Germany | 33/11 |
| 0560154 | 9/1923 | France | 33/17 R |
| 1106863 | 12/1955 | France | 33/12 |
| 0302227 | 10/1932 | Italy | 33/11 |
| 0577917 | 7/1958 | Italy | 33/12 |
| 0612678 | 6/1978 | U.S.S.R. | 33/12 |

*Primary Examiner*—William A. Cuchlinski, Jr.
*Assistant Examiner*—Thomas B. Will
*Attorney, Agent, or Firm*—Bucknam and Archer

[57] ABSTRACT

The present invention provides a method of preparing a pattern drawing in upper body tailoring by making use of the data obtained from the measure of shoulder depth, arm girth at armpit, shoulder width, back width, neck base girth, back waist length, front waist length, bust point length, chest girth, breast depth, bust breadth, and abdomen depth. The pattern drawing fits all kinds of body figures.

5 Claims, 11 Drawing Sheets

BASIC FORMULA FOR ACTIVE SKETCH PATTERN DRAWING IN UPPER BODY TAILORING

BACKGROUND OF THE INVENTION

The present invention relates to a method of drawing a pattern in upper body tailoring and more particularly, a method of measuring the figure of a human body so as to adapt to the differences in the body figure.

Conventional pattern drawing in tailoring is the same for different people and does not discover the defects in the body figure for compensation in advance, so that misfits happen quite often and further alteration is usually required. Therefore, conventional pattern drawing methods are not satisfactorily applicable in mass production.

The main object of the present invention is to provide a method in body figure measurement for a pattern drawing in upper garment tailoring so as to promote the quality, reduce the loss, increase the productivity and the profit.

Another object of the present invention is to provide such a sketch pattern drawing that the dressmaker can easily handle with the variation in body figure while tailoring so as to avoid any further alteration.

DETAILED DESCRIPTION OF THE DRAWINGS

Figure 1:
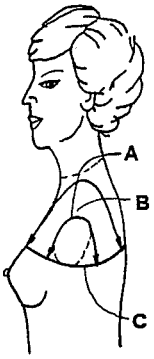
FIGS. 1–14 show the measures to be taen according to the present invention.
Figure 2:
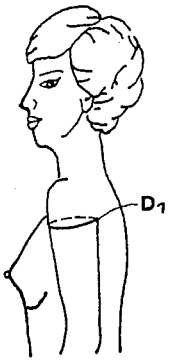
Figure 3:
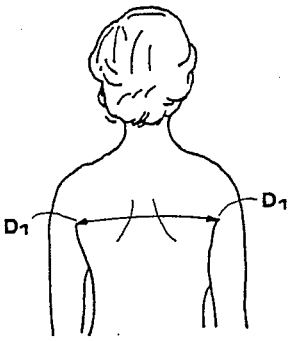
Figure 4:
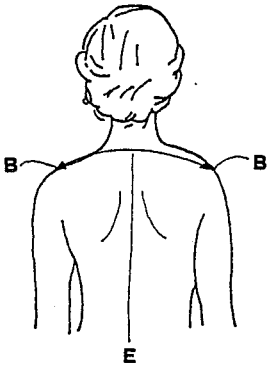
Figure 5:
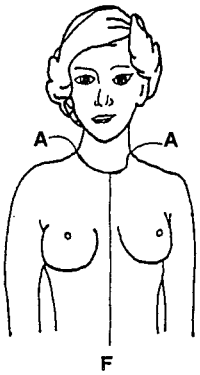
Figure 6:
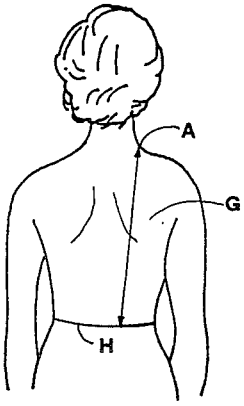
Figure 7:
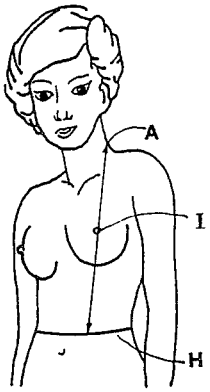
Figure 8:
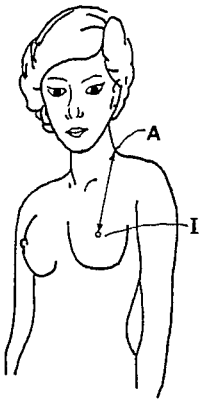
Figure 9:
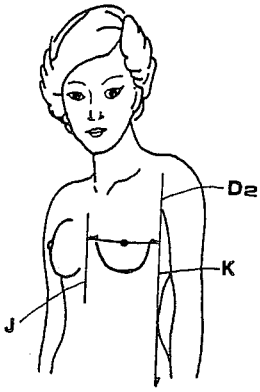
Figure 10:
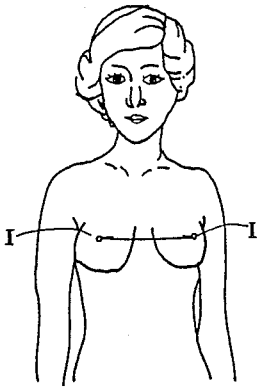
Figure 11:
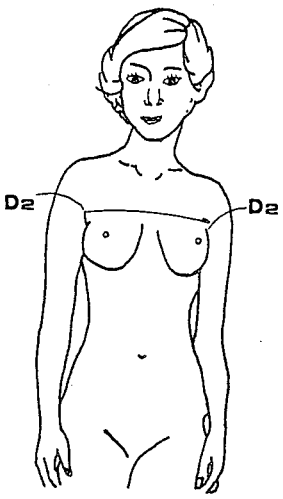
Figure 12:
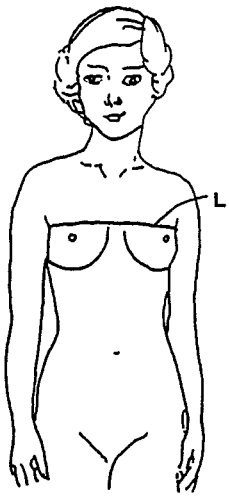
Figure 13:
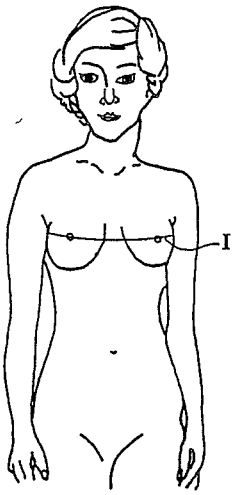
Figure 14:
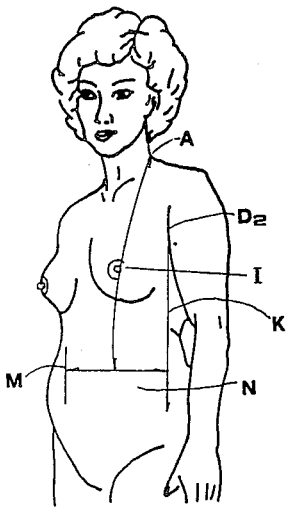

By reference to the drawings, FIGS. 1–14, the measures to be taken are designated as described hereinbelow:

A. Neck point (FIG. 1);
B. Shoulder point (FIG. (2);
C. Chest level at armpit (FIG. 1);

D. Back armpit point (D1), front armpit (D2), (FIGS. 2, 3, 9);
E. Back neck central point (FIG. 4);
F. Front neck central point (FIG. 5);
G. Shoulder blade (FIG. 6);
H. Waist line (FIG. 7);
I. Bust point (FIGS. 7, 8)
J. Front central line (FIG. 9);
K. vertical line of front armpit point (FIG. 9);
L. Chest level at armpit (FIG. 12);
M. Abdominal center (FIG. 14);
N. Abdomen (FIG. 14);

The measuring method applied according to the present invention is characterized in that:

Shoulder depth (FIG. 1): The difference between the shoulder depth from point (A) to point (C) and the shoulder depth from point (B) to point (C). By this measurement, the shoulder line position can be precisely allocated and the depth of shoulder point can be properly obtained.

Arm girth (FIG. 2): One circle around the upper arm at point (D1). By this measurement, the depth and the width of armhole can be properly obtained, the curve of the arm hole is very stable, and the width and the depth of the sleeve cap can match with the arm hole properly. As the sleeve cap and the arm hole are set, any variation of lower piece or sleeve width will not interfere with the result.

Back width (FIG. 3): The size of the back of human body between both armpit points (D1). By this measurement when a dress is put on, it will perfectly match with the position of the points (D1), any style variation will not interfere with the comfortable result.

Shoulder width (FIG. 4): the size between both shoulder points through back neck central point (E). This measure provides an accurate shoulder width.

Neck base girth (FIG. 5): One circle around the neck base through both neck points (A) and front neck central point (F). By this measurement, accurate collar width and depth can be accurately obtained.

Back length (FIG. 6): The size from neck point (A) through shoulder blade (G) to waist line (H). Because the size of shoulder blade varies with people, by means of this measurement accurate back length can be obtained.

Front length (FIG. 7): The size from neck point (A) through bust point (I) to waist line (H). By means of this measurement, the front length obtained is more accurate for any style variation.

Bust depth (FIG. 8): The size from neck point (A) to bust point (I). This measurement is for determination of breast depth.

Breast depth (FIG. 9): the size from the vertical line of front armpit (K) through bust point (1) to front central line (J). By means of this measurement, any style variation will perfectly meet the breast depth required.

Bust width (FIG. 10): The size between both bust points (I). By this measurement any finished dress will perfectly meet with the actual size.

Bust breadth (FIG. 11): The size between both front armpit point (D2). By this measurement, an accurate bust breadth can be obtained and any finished dress will perfectly meet with the actual size.

Chest girth (FIG. 12): The size of one circle around the chest through armpit points. The size obtained according to this measurement is very accurate for reference in style variation.

Breast girth (FIG. 13): The size of one circle around the chest through both bust points (I). The size obtained according to this measurement is very accurate for reference in style variation.

Abdominal depth (FIG. 14): The size of a radial line from the vertical line of the armpit point (K) through the abdomen to the abdominal center (M). By this measurement, an accurate abdominal depth and the difference of the abdominal depth and the bust depth can be accurately obtained. The dress finished according to this measurement will perfectly fit the body.

Figure 15:
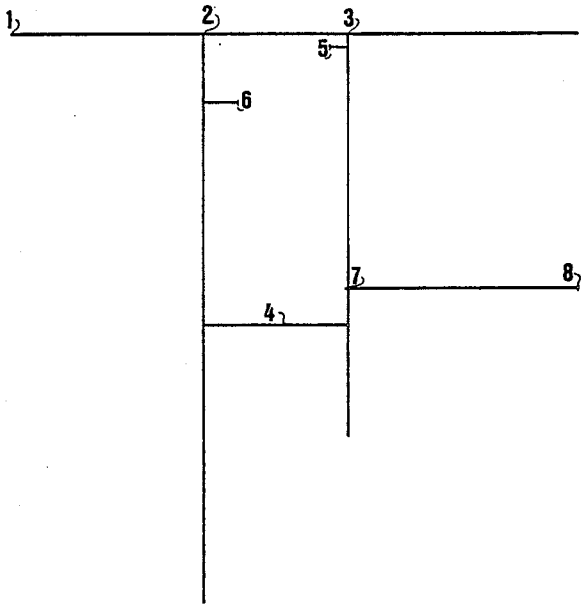
FIGS. 15–20 show the sketch drawing method according to the present invention.

According to the data obtained from the above measurement, start the basic sketch pattern drawing as follows:

Firstly draw an initial line for armhole as shown in FIG. 15, by drawing a horizontal line from a free point (1) and set a point (2) rightwardly along the horizontal line at a proper distance and draw a vertical line downward from the point (2) as for the front side line; to set a point (3) rightwardly along the horizontal line (1) from point (2) at a distance equal to ¼ of arm girth and 4 cm. (the distance between points (2) and (3) is equal to the width of armhole), then drawing a vertical line downward from point (3): drawing a horizontal line (4) downward from the point (2) or point (3) at a distance equal to ¼ of arm girth+ 14 cm as for armhole depth; setting a back shoulder point (5) downward from point 3) at a distance equal to 1/6 of shoulder width and at 1.3 cm leftward from the vertical line from the point (3); setting a front shoulder point (6) downward from point (2) at a distance equal to 4/6 of shoulder width—0.5 cm and at 2.5 cm rightward from the vertical line from the point (2); setting a back armpit point point (7) at 2.5 cm upward along the vertical line from point (3) from the horizontal line (4); drawing a horizontal line rightward from point (7) for back width and setting a point (8) at a distance equal to ½ of back width, and the distance between points (7) and (8) is equal to the back width.

The above-described armhole sketch pattern drawing method is based on the upper arm girth, and it can provide an accurate sleeve width and proper armhole depth. With the shoulder depth obtained according to present basic sketch pattern drawing formula, accurate position can be precisely obtained. For style variation, the size should be increased or decreased properly according to the depth and the width set in the basic sketch pattern. The position of armhole is to be determined initially and is not interfered by the size or the style for the front or the back body, and therefore, armhole and sleeve cap can be exclusively designed.

Figure 16:
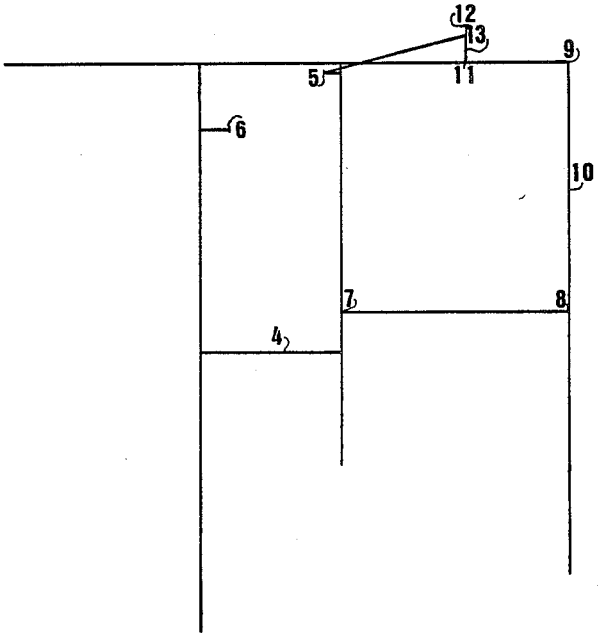

The sketch drawing method as shown in FIG. 16 is performed by setting a point (9) rightward along the horizontal line (1) at a distance equal to ½ of shoulder width from point (5). If the shoulder width point (9) is wider than the back width point (8), then draw a vertical line downward from point (9) for back central line (10). If the back width point is equal to the shoulder width point, then draw a vertical line through points (9) and (8). If the back width point (8) is wider than the shoulder width point (9), draw a vertical line through point (8) for back central line (10). Then set a point (11) leftward from the cross point between the horizontal line (1) and the back central line (10) at a distance equal to 1/6 of neck base girth + 1.3 cm so as to obtain the size for the back collar width; set a point (12) at 2 cm upward vertically from point (11) so as to obtain the size for the depth of the back neck point, and then set a point (13) at 0.5 cm downward from the point (12), and draw an oblique line to connect points (5) and (13).

When the shoulder width and the back width have been obtained, the sketch pattern drawing for any body figure can be completed according to the present method, and proper shoulder dart is obtained because the back width point (8) and the shoulder width point (9) are fixed; moreover, according to the accurate neck base girth obtained and the present sketch drawing method, proper collar width can also be obtained accordingly.

Figure 17:
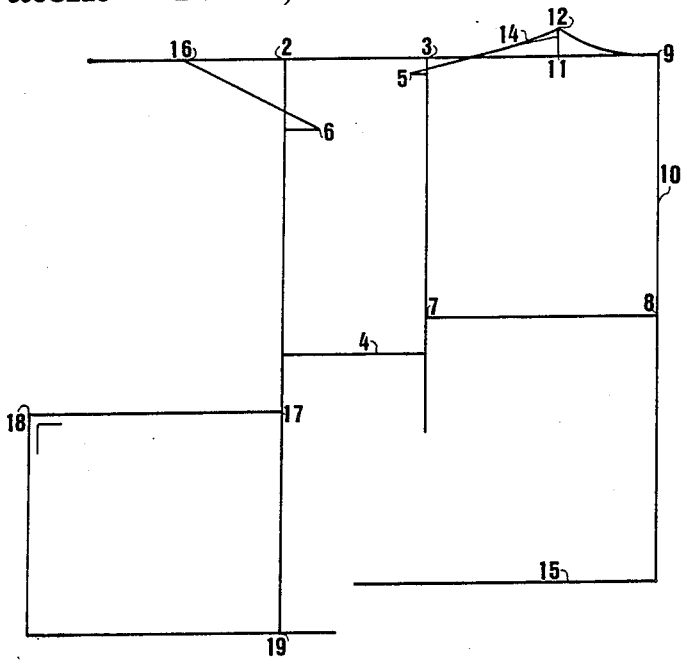

By reference to FIG. 17, draw a curved line from point (12) of a length of 3 cm to connect with the line between points (5) and (13) at point (14); draw a horizontal line downward from point (12) at a distance equal to back length for the back waistline (15); set a point (16) along the horizontal line (1) left-upper side from the point (6) at a distance equal to the distance between points (5) and (12) for front neck point. If shoulder dart is used, deduct the size for shoulder dart. Then set a point (17) for bust depth downward from point (2) at a distance equal to bust depth and then set a point (18) for breast depth leftward along a horizontal line from point (17) at a distance equal to the breast depth. If breast depth produces over abdominal depth, draw a vertical line downward directly from point (18). Then set a point (19) downward directly from point (2) at a distance equal to the front length and draw a horizontal line for front waistline. In this manner, the difference in size between front waistline (19) and back waistline (15) is obtained.

In the above drawing method the line from shoulder point to neck point is not straight, and the shoulder line close to neck point is to be drawn curved. The size of back length from neck point to waistline is to match with the position and the size of the back length obtained according to the present measuring method so that the finished product will provide an accurate back length. The length between points (5) and (12) is equal to points (6) and (16) to allow the process in accordance with the fixed back shoulder width to measure from the front shoulder point so that the part below the front armhole is not interfered. The front length from the upper horizontal line (1) to the waistline (19) is according to the front length obtained from the present measuring method, and the difference in size between front part and back part thus obtained according to the sketch pattern drawing formula is equal to the bust dart required. The breast depth (18) from armpit vertical line (2) to the front central line through present pattern method provides an accurate size at accurate position.

Figure 18:
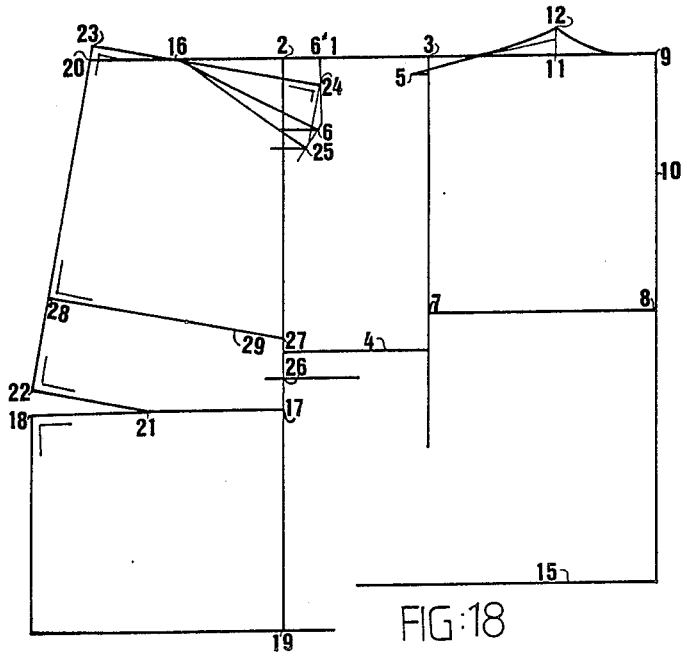

By reference to FIG. 18, set a point (20) leftward along the horizontal line (1) from point (16) at a distance equal to the back collar width—0.5 cm for the front collar width; set a bust point (21) rightward along the horizontal line from point (18) at a distance equal to ½ of the bust width, then use a triangle with the short side aimed at point (21) in a length equal to the size between points (18) and (21) and with the longer side aimed at point (20) draw a rectangular line by both sides of the triangle to cross at the peak point (22). In this manner, the expansion of central bust dart between points (18) and (22) is obtained. Then use a triangle with the longer side aimed at the connecting line between points (20) and (28) and with the short side passing through neck point (16) obtain a cross point (23) to form an adjusted front shoulder line; draw a vertical line upward from point (6) so as to obtain a cross point (6') with the horizontal line (1); then set a point (24) from point (16) along the extension line through points (23) and (16) at a distance equal to the length between points (16) and (6'), then use a triangle with long side aimed at the connecting line between points (16) and (24) so as to set a point (25) along the short side of the triangle from the point (24) at a distance equal to the distance between points (6') and (6) as a moved shoulder point, and then draw a line to connect points (16) and (25); draw a horizontal line below the horizontal armhole line (4) at a distance equal to the depth between points (1) and (24) so as to obtain a cross point (26) with the vertical front side line (2) for adJustment of the armpit line; set a front armpit point (27) at 2.5 cm upward along the vertical line from point (26); use a triangle with long side aimed at the connecting line between points (20) and (22) and with the short side passing through point (27) so as to obtain a peak point (28), then draw a line to connect points (27) and (28) for the bust breast line, then set a point (29) rightward from point (28) along the bust breast line at a distance equal to ½ of bust breast.

In the above method, the front collar width extends from front neck point and is 0.5 cm shorter than back collar width, which arrangement results in a smooth collar opening since the front neck part of most people is inclined inwardly in comparison with the chest part. The arrangement of the bust central line produces the required bust dart. The adjustment of front shoulder line from bust central line turns to front neck point at a right angle to match with the variation of breast depth and to obtain a proper position for shoulder seam. The position and the size of the bust breadth according to the present method keeps the finished product properly matched.

Figure 19:
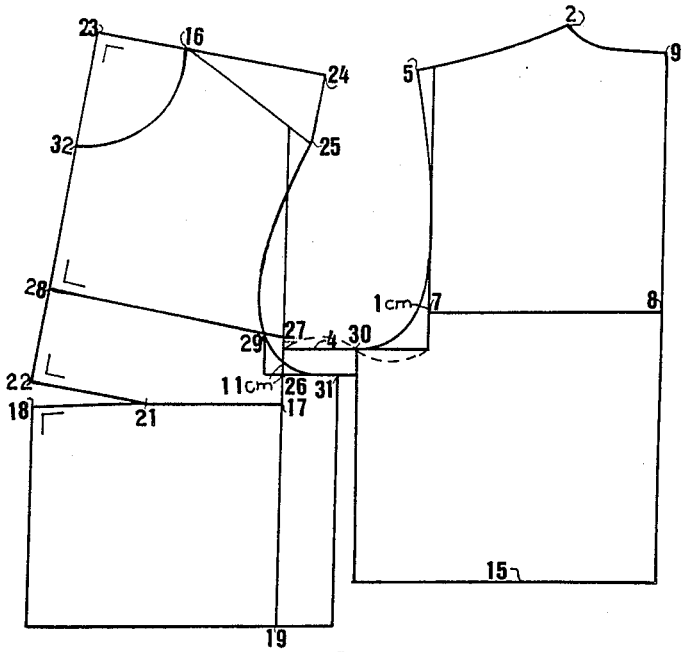

By reference to FIG. 19, set a point (30) along the horizontal line (4) from the vertical line (2) at a distance equal to ½ of armhole width and draw a vertical line downward from the point (30), then set a point (31) leftward from the point (26) at a distance equal to the distance between points (27) and (29) and draw a vertical line to temporarily separate front and back side line. Then set a point (32) for the depth of front collar opening downward from point (23) along the connecting line between points (23) and (22) at a distance equal to 2 cm + the size between points (16) and (23). By this method the adjustment of the armhole is characterized in that after the point for bust breadth is determined, the distance between bust breadth point and armpit point is obtained. Then deduct this size from the original armhole width frontward from the half line, keep the armhole in original size, and then draw the armhole curved line. The front collar opening depth is completed after central line and the shoulder line are determined so that an accurate size can be properly obtained.

According to above described method, draw a line to connect points (5), (14) and (12) for the back shoulder width, to properly draw a curved line from point (12) to cut with the horizontal line (1) and extend to the back central line (10) for the collar opening. Draw a curved line from point (5) to cut with vertical lines (3), (7) and horizontal line (4) up to the point (30) for back armhole, then combine with back central line (10), vertical side line (30), and back waistline (15) to form a basic pattern for back part of the upper body. Then connect points (16) and (25) for front shoulder length, draw a curved line to connect points (16) and (32) for the collar opening, draw a curved line from point (25) through point (29) to cut with horizontal line (31) for the front armhole. Draw a straight line to connect points (32) and (22), a straight line to connect points (22) and (21), a straight line to connect points (21) and (18) so as to leave a black space between points (18) and (22) for the bust dart. Draw a line from the front central line (18) downward from the side vertical line (31) downward and the front waistline (19) to form a basic pattern for the front part of the upper body (FIG. 19). Then combine the front part pattern and the back part pattern at respective side line point (30) and (31) along the vertical lines to complete a basic sketch pattern for the upper body as shown in FIG. 21.

Figure 20:
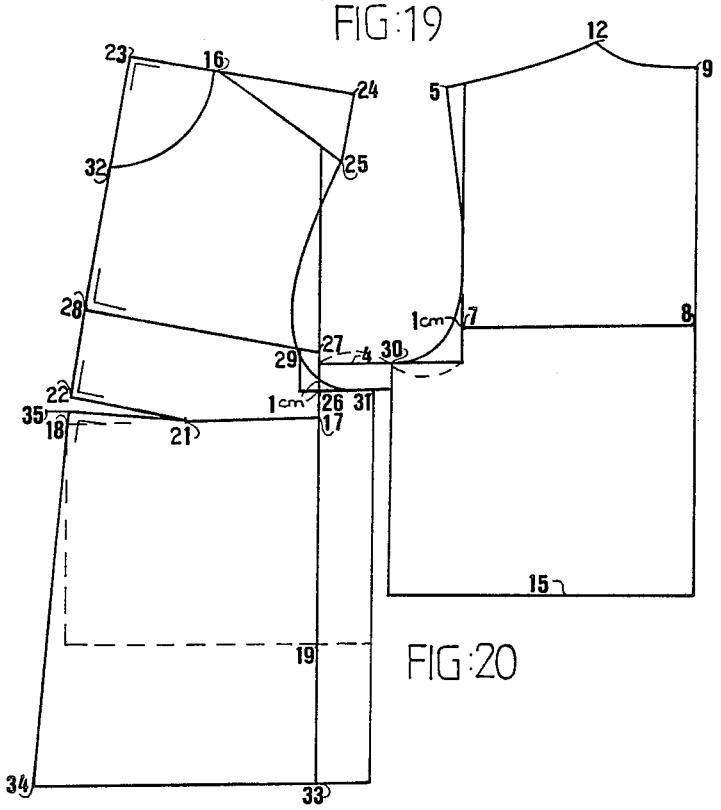

In a body figure where abdominal depth protrudes beyond breast depth, as illustrated in FIG. 20, use the described basic pattern and set a point (33) at 1O cm downward along the vertical line from the front waistline (19) and draw a horizontal line for abdominal level; set a point (34) leftward along the abdominal level from point (33) at a distance equal to abdominal depth; use a triangle with the short side aimed at the bust point (21) in a length equal to ½ of the bust width and with the long side of the triangle passing through point (34) so as to obtain a peak point (35) at the right angle to form a correcting angle, in which the space between points (22) and (35) is for natural bust dart.

In the above described body figure, the protruding part of the abdominal depth beyond the breast depth is just below the front bust breadth. With the obtained data to draw according to present sketch pattern formula, the finished product will match perfectly with the measures and the front closings can be very smooth.

Figure 21:
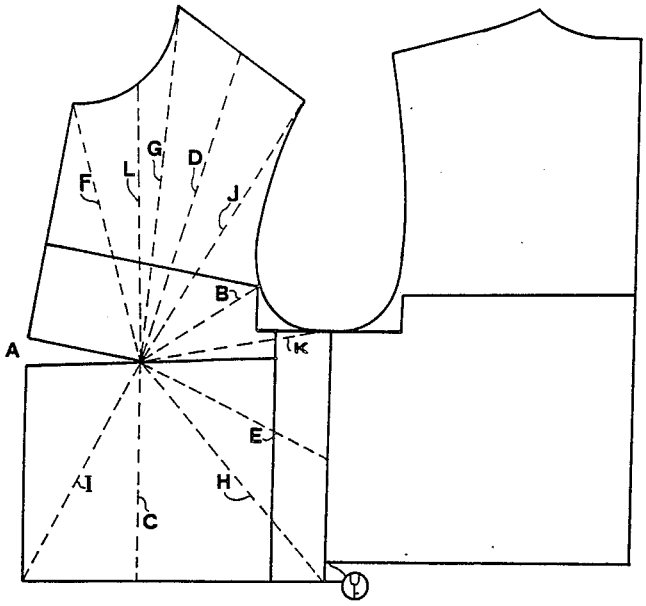
FIGS. 21–22 illustrate the bust dart by moving sunray-like pleats.
Figure 22:
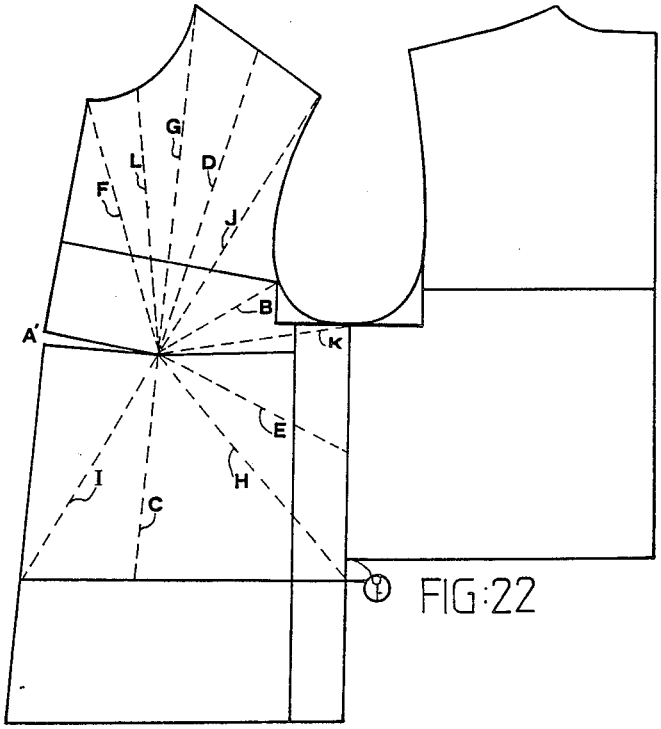

In the preferred embodiment according to the present invention, the bust dart can be adjusted by means of the use of sun-ray lines as shown in FIG. 21 wherein the size (A) between points (10) and (22), and the size (A') between points (35) and (22) in the body figure where abdominal depth is protruding beyond breast depth as shown in FIG. 22, both are for basic bust dart. Other lines b, c, d, e, f, g, h, i, j, k, 1 are for combination of basic bust dart (A) or (A') to shift to proper line; as the top points of front side line and back side line are directed together, the difference in size at the bottom can be left at original place or be shifted to the sun-ray lines. If left at original place, 2 cm is the maximum size, and the excessive part should be distributed to the sun-ray lines.

The application of the bust dart in basic pattern for upper body is performed according to style and the side line of front part or back part can be freely allocated without limitation, and the bust dart is removable according to the style for front body and not fixedly set at a position, more particularly, a proper size of bust dart can always be kept while changing its position to match with the variation of the breast depth.

In a preferred embodiment according to the present invention, the sketch pattern is determined according to the variation of style.

Figure 23:
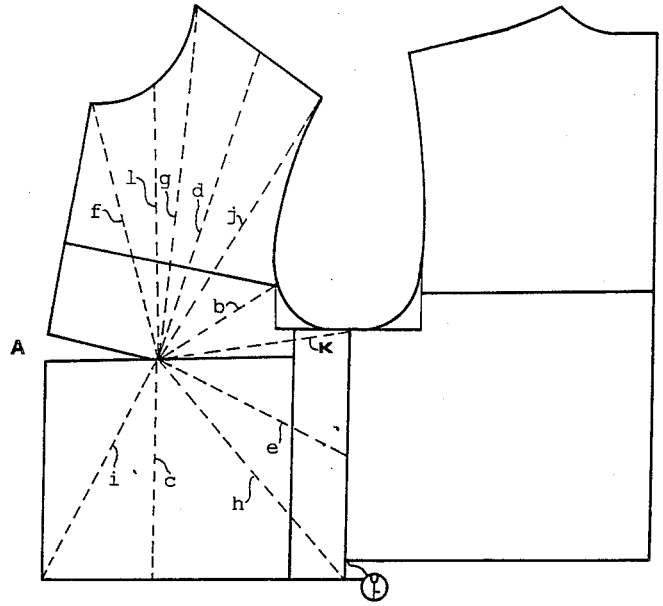
FIG. 23 illustrates application of style variation according to the present invention.
Figure 24:
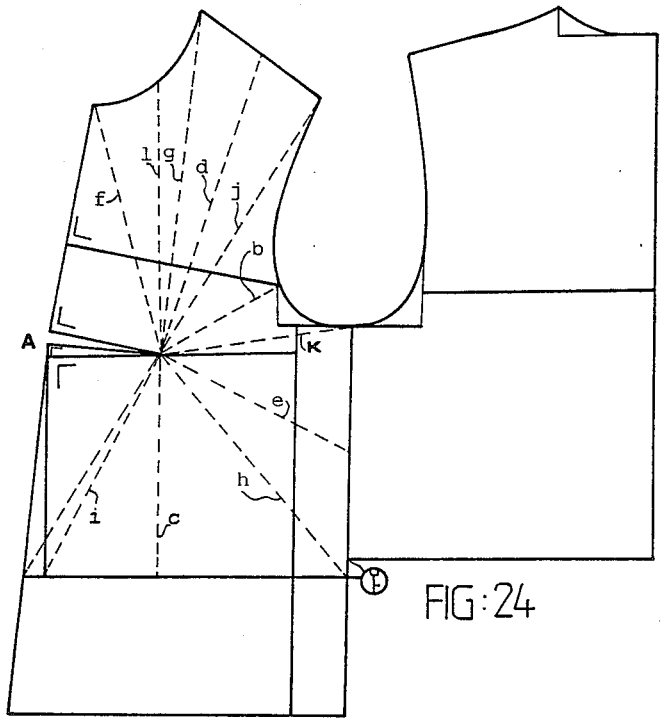
FIG. 24 is a plain view of a basic sketch pattern for upper garment according to the present invention.

Please refer to FIGS. 23 and 24 for the detailed description:

(1) To determine a preliminary position for the basic bust dart (sun-ray a or a'), to include the difference in size between front side line and back side line.

a(a') line: If the front center is separated, cut for joining and needs to be pleated or gathered, the a, (a') position is applicable.

b line: Armhole armpit point, if the area above or beneath the armpit point needs to be gathered, pleated or cut for joining, the b position is applicable.

c line: Below the bust point, if the waist joining line is to be gathered, pleated or cut for joining upward, the position c is applicable.

d line: Shoulder center, if the shoulder needs to be gathered, pleated or cut for joining, the position d is applicable.

e line: Between side armhole and waistline, if the side line needs to be cut for joining, gathered or pleated, the position e is applicable.

f line: Front center collar opening, if collar opening needs to be cut, gathered or pleated, the position f is applicable.

g line: Neck point, if the shoulder line close to neck point needs to be cut for joining, gathered or pleated, the position g is applicable.

h line: If the bottom corner of the side line of the front part needs to be cut for joining, gathered or pleated, the position h is applicable.

i line: If the bottom corner of the front center needs to be cut for joining, gathered or pleated, the position i is applicable.

j line: If the shoulder point needs to be cut for joining, gathered or pleated, the position j is applicable.

k line: If the area below the armpit at the division of the front part and the back part needs to be cut for joining, gathered or pleated, the position k is applicable.

l line: If the lateral side of the front collar needs to be cut for joining, gathered or pleated, the position 1 is applicable.

(2) To recognize the size determined according to the basic method, if upper bust dart line is set, consider the armpit width of the armhole according to the size added or deducted from the armpit width of the style preferred and determine the dividing line of the front part and the back part. After the above is done, determine the position of the armhole according to the basic formula and then make adjustments according to style preferred.

(3) As soon as the size of the armpit width of the armhole is determined and the sketch is finished, start drawing for either front part or back part; if for back part, start sketch drawing for one full piece or half piece according to the size between both back armpit points and the style preferred; for the style of shoulder sleeve or shoulder slope, extend over shoulder point and match with the style of the armhole at the side line. The sleeve length is also determined in this way; for the variation of back part arranged in straight or slope within the area according to the basic formula the smooth effect of the clothes will not be affected.

For the front part, the method is carried out in the same way as for the back part: draw for the width preferred according to the style of closing after bust line (sun-ray line) is moved to a proper position, and then the proper effect can be obtained in any variation within the area according to the basic formula.

Figure 25:
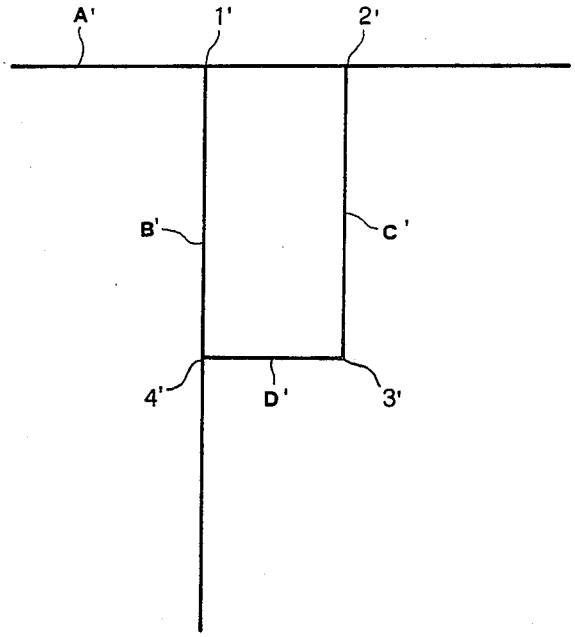
FIG. 25 shows a preferred embodiment according to the present invention, illustrating basic line drawing technique for body piece.

For full understanding, the pattern of the following preferred embodiment is for half body and completed in ¼ scale drawing technique. The size is indicated in centimeter, the number represents point, the letter represents a line, and "" represents right angle. By reference to FIG. 25, first draw a free horizontal line (A') in a length equal to ½ of the breast girth. (Since in this embodiment, the breast girth is 86 cm, draw a horizontal line of 43 cm.) Then set a point 1' rightward from the left end of the line (A') at a distance equal to one-third of the length of the line and draw a vertical line (B') downward from the point (1') as an armpit vertical line of the front body; set a point (2') rightward along the horizontal line (A'Z) from point (1') at a distance equal to ¼ of the arm girth at armpit point plus 2 cm to 5 cm, (in the embodiment, the arm girth is 28 cm, the size preferred is 7 cm+4 cm=11 cm), and draw a vertical line (C'). Then set a point (3') downward along vertical line (C') from point (2') at a distance equal to ¼ of arm girth+ 14 cm (21 cm in the embodiment) and draw a horizontal line (D') to connect with vertical line (B') at cross point (4'). The length between points (3') and (4') is equal to the length between points (1') and (2').

Figure 26:
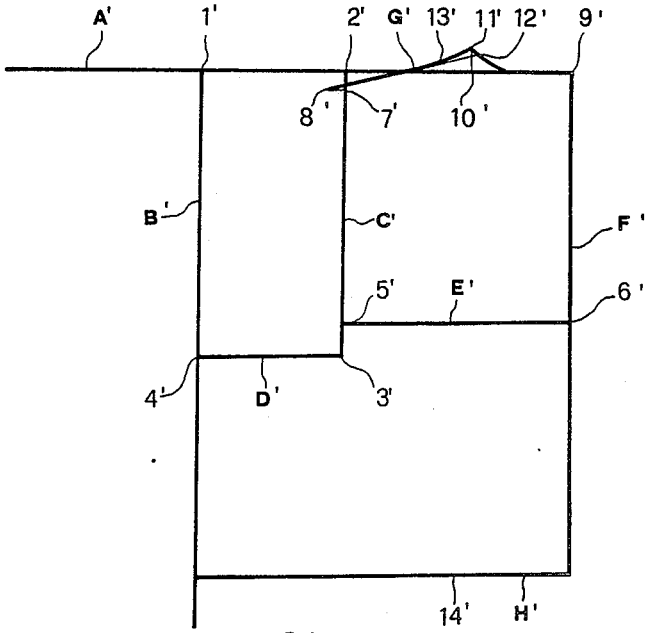
FIG. 26 shows a preferred embodiment according to the present invention, illustrating one-half sketch pattern drawing for back piece.

By reference to FIG. 26 for the following description, set a point (5') at 2.5 cm upward along vertical line (C') from the point (3') and draw a horizontal line (E') rightward, then set a point (6') rightward along the horizontal line (E') from the point (5') at a distance equal to ½ of the length between both back armpit points, 17.2 cm in this embodiment; then set a point (7') downward along vertical line (C') from the point (2') at a distance equal to 1/6 of the shoulder slope (in this embodiment, the shoulder slope is 8.4 cm, and the size thus obtained is 1.4 cm) and draw a horizontal line leftward of 1.3 cm to obtain a point (8'); set a point (9') on the horizontal line (A') in right upper side from point (8') at a distance equal to ½ of the size between both shoulder points, that is, 18.8 cm in this embodiment; compare the position of point (9') and point (6') and draw a vertical line (F') for back central line from the wider point if point (6') is wider than point (9'). Then draw a vertical line through point (6'); if point (9') is wider than point (6'), draw a vertical line downward from point (9'); set a point (10') leftward along the horizontal line (A') from point (9') at a distance equal to 1/6 of neck base girth+ 1.3 cm, that is, 7.5 cm in this embodiment, and draw a vertical line upward from point (10') in a size equal to 1/16 of neck base girth− 0.3 cm, that is, 12 cm in this embodiment, so as to obtain a point (11'); set a point (12') at 0.2 cm downward along the vertical line from point (11') and draw an oblique line (G') to connect points (8') and (12'), then set a point (13') at 3 cm from point (12') along the oblique line and then draw a curved line to connect points (11') and (13') and another curved line from point (11') downward to the right to cut with the horizontal line (A') at the central point between points (9') and (10') and to extend along the horizontal line (A') up to the point (9'); set a point (14') for back neck side back length downward from point (11') at a distance equal to the size from top back neck point through shoulder blade to waistline, 39.4 cm in this embodiment, and draw a horizontal line (H') to connect with vertical lines (B') and (F').

Figure 27:
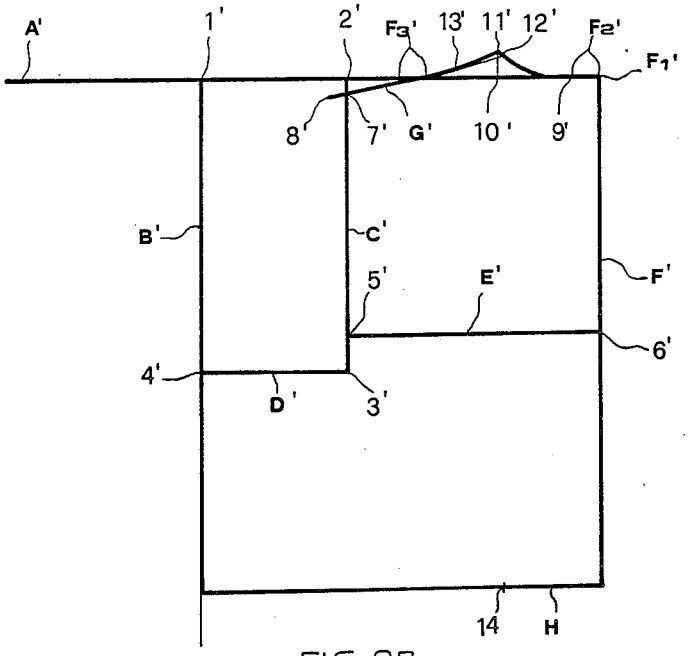
FIG. 27 shows a preferred embodiment according to the present invention illustrating a sketch pattern drawing for back piece wherein the length between points (6) and (5) is greater than the length between points (9) and (2).

By reference to FIG. 27 wherein the length between points (6') and (5') is greater than the distance between points (9') and (2'), draw a vertical line through point (6') to cross upwardly with horizontal line (A') at cross point (F1'), and cross downwardly with horizontal line (H'), to designate the distance between points (F1') and (9') as (F2'); then set a point (10') leftward along the horizontal line (A') from the point (F1') at a distance equal to 1/6 of neck base girth + 1.3 cm, that is, 7.5 cm in this embodiment; set distance (F3') in same size as (F2'). Other measures are the same as that described in FIG. 26.

Figure 28:
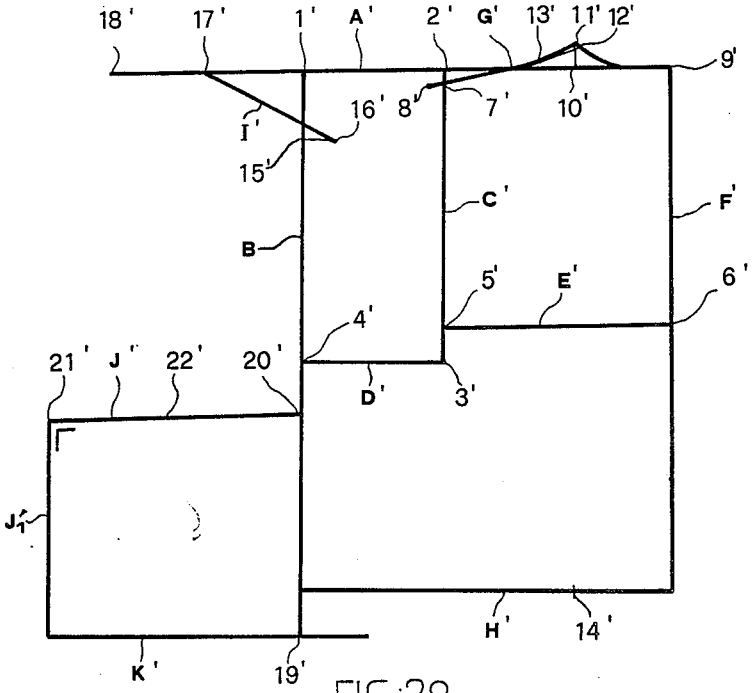
FIGS. 28–29 show a preferred embodiment according to the present invention, illustrating one-half pattern drawing for front piece.

By reference to FIG. 28 set a point (15') downward along the vertical line from point (1') at a distance equal to 4/6 of shoulder slope, 5 cm in this embodiment, and draw a horizontal line rightward from the point (15') of 2.5 cm so as to obtain a point (16'); draw a straight line (I') left-upperward from point (16') of a length equal to the distance between points (8') and (11') to cross with the horizontal line (A') at a point (17') In the embodiment illustrated in FIG. 27, the width of (F2') should be deducted. Then set a point (18') along the horizontal line (A') from the point (17') at a distance equal to the distance between points (10') and (9') or the distance between points (10') and (F1')—0.5 cm, that is, 7 cm in this embodiment. Then set a point (19') for front length, downwardly along the vertical line (B') from the point (1') of the horizontal line (A') at a distance equal to the distance from the top neck point of the front body through bust to waistline, that is 40.6 cm in the embodiment, and draw a horizontal line (K'); set a point (20') downward along the vertical line (B') from the point (1') at a distance equal to the distance from bust point to neck point, that is, 24.8 cm in this embodiment and draw a horizontal line (J') leftward from the point (20'), then set a point (21') leftward along the horizontal line (J') from the point (20') at a distance equal to the length from the armpit vertical line to the bust point, that is, 19 cm in this embodiment. Then draw a vertical line (J1') downward from the point (21') against the horizontal line (J') to cross with the horizontal line (K'); set a point (22') leftward along the horizontal line (J') from the point (20') at a distance equal to ½ the width between both bust points, 9 cm in this embodiment.

Figure 29:
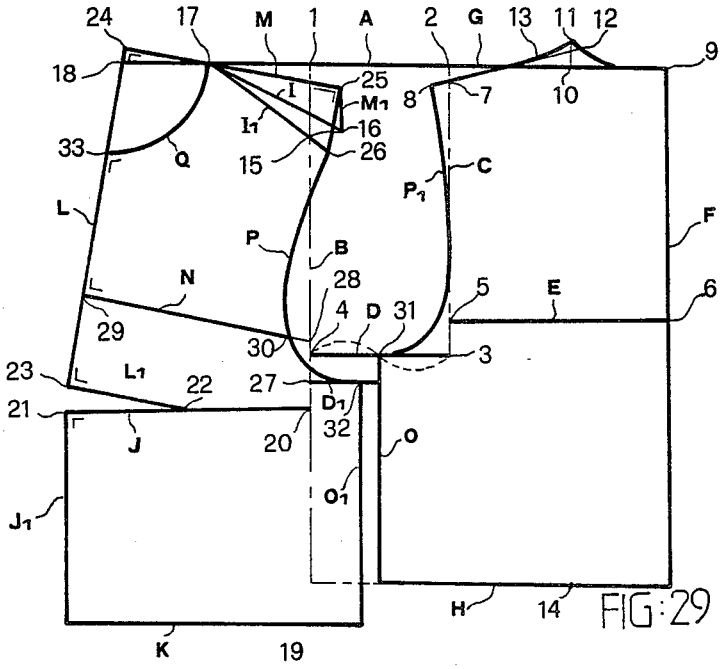

By reference to FIG. 29 use a triangle with long side aimed at point (18) and with short side aimed at point (22) in a length from angle point equal to the size between points (21) and (22), draw a line (L) for long side and (L1) for short side to obtain an angle point (23); then use a triangle again with long side aimed at the oblique line (L) letting the short side pass through point (17) and draw an oblique line (M) so as to obtain a top angle point (24); then draw a vertical line upward from point (16) to cross with the oblique line (M) so as to obtain a top angle point (24); then draw a vertical line upward from point (16) to cross with the oblique line (M) at a cross point (25); then use a triangle with one side aimed at the oblique line (M) and with the angle point of the rule passing through point (25) draw an oblique line (Ml) so as to set a point (26) downward along the oblique line (Ml) from the point (25) at a distance equal to the length between points (1) and (15). The line from point (17) to point (16) is naturally equal to the line from point (17) to point (26). Then draw an oblique line (I1) to connect points (17) and (26); set a point (27) downward along vertical line (B) from the point (4) at a distance equal to the length from horizontal line (A) to point (25) and set a point (28) at 2.5 cm upward from point (27) and draw a line (N) from the point (28) against oblique line (L) to cross with the line (L) at a cross point (29); set a point (30) rightward along the oblique line (N) from the point (29) at a distance equal to ½ of the width between two front armpit points, that is, 16.5 cm in this embodiment; set a point (31) at the center of the horizontal line (D) between points (3) and (4) and draw a vertical line (D) downward from the point (31) to cross with the horizontal line (H); draw a horizontal line (D1) from the point (27) to cross with the vertical line (0) and set a point (32) leftward along horizontal line (D1) at a distance from the vertical line (0) equal to the length between points (28) and (30) and then draw a vertical line (01) downward from the point (32) to cross with the horizontal line (K); draw a curved line (P) downward from point (26) to point (30) and extend 2 cm from point (26) to cut with the horizontal line (D1) up to point (32) to form a curved armhole line (P) for the front part; draw a curved line downward from point (8) to cut with the line (C) and then extend 1 cm from point (5) to cut with the horizontal line (D) up to point (31) to form a curved armhole line (Pl) for the back part; set a point (33) downward along the line (L) from the point (24) at a distance equal to the length between points (24) and (17) + 1.23 cm; draw a line inward from point (33) at a right angle of a length of 1 cm and then draw a curved line upward to the point (17) to form a front neck point curved line (Q).

Figure 30:
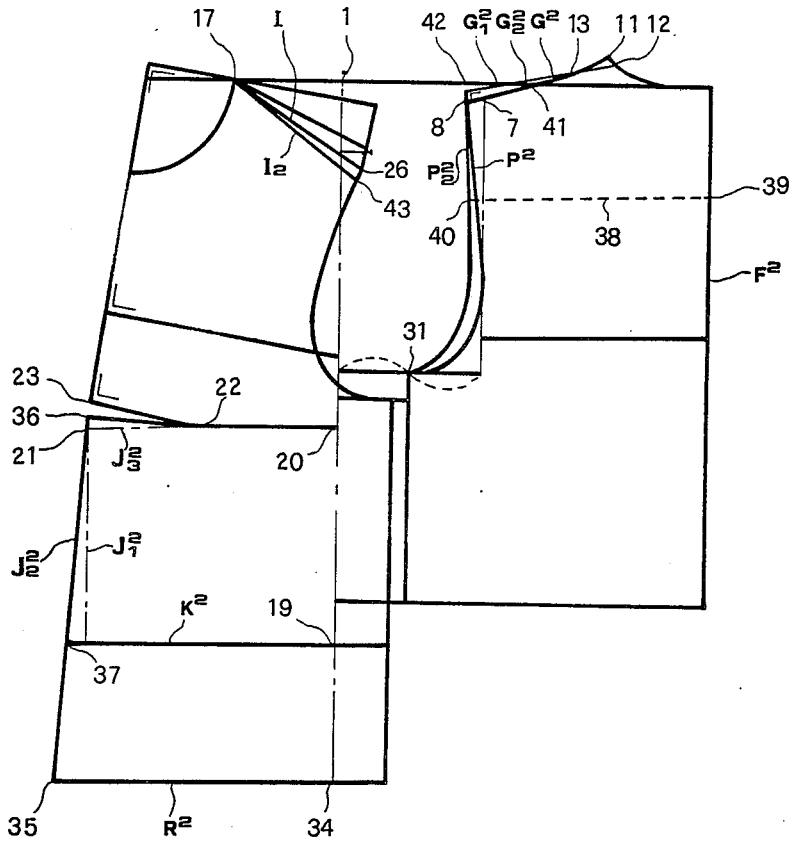
FIG. 30 shows a preferred embodiment according to the present invention, illustrating a one-half pattern drawing for front piece in which the abdomen size is bigger than the chest size.

By reference to FIG. 30, this is the drawing of central line for one-half the front piece where the size of abdomen is bigger than the bust, the width of shoulder blade to both armhole line is bigger than the width between both shoulder points, the back armhole line and the shoulder line for front part and back part are drawn as described hereinbelow. Set a point (34) downward along the vertical line from point (1) of the horizontal line (A) at a distance equal to the size from top neck point through bust to the abdominal level, that is, 52 cm in the embodiment described. Then draw a horizontal line (R); set a point (35) leftward along the horizontal line (R) from the point (34) at a distance equal to the width from the armpit vertical line to the protruding part of the abdomen, that is, 21.5 cm in the described embodiment; use a triangle with long side aimed at point (35), and with the short side passing through point (22) of a length equal to the length between points (21) and (22) and draw an oblique line (J2) and another oblique line (J3) respectively along both sides of the triangle to obtain an angle point (36); set a point (37) at the cross point between horizontal line (K) and oblique line (J2); the basic sketch pattern for the upper body is thus obtained.

Figure 31:
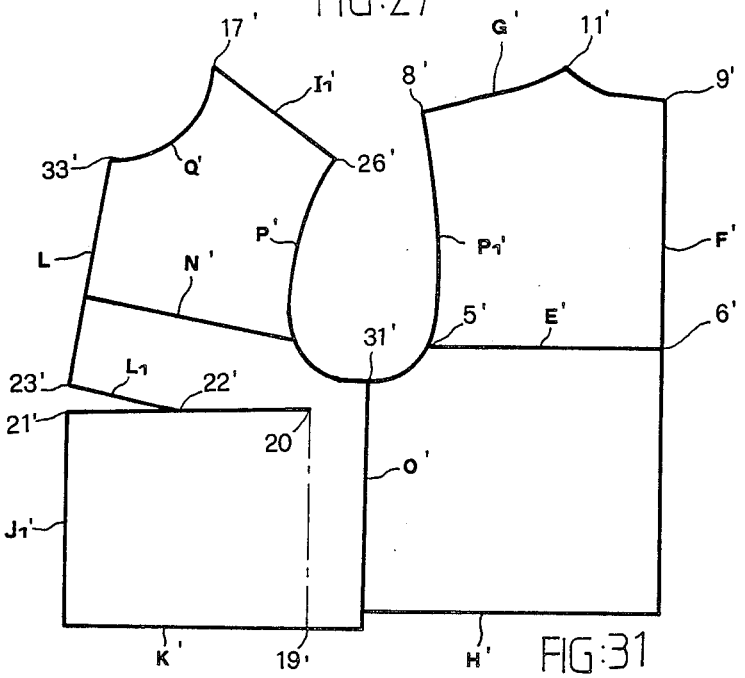
FIG. 31 shows a preferred embodiment of the basic style according to the present invention.

When the width of shoulder blade is greater than the width between both shoulder points, the drawing method for the armhole line for back piece and for the front and back shoulder lines is carried out as follows: set a point (38) downward from point (11) at a distance equal to the size from back neck point to the shoulder blade level, that is, 10 cm in the described embodiment and draw a horizontal line to cross with the vertical line ($F^2$) at point (39), then set a point (40) leftward along the horizontal line from point (39) at a distance equal to ½ of the width between both left and right armhole lines which is measured at a level 1O cm below back neck point around the shoulder blade, that is, 18.5 cm in the described embodiment; set a point (41) at the center between points (8) and (11); use a triangle with one side aimed at points (8) and (40), and with another side aimed at point (41); then draw oblique lines ($G1^2$) and ($P2^2$) to cross at angle point (42); draw a curved line from the point (42) downward along oblique line ($P2^2$) through point (40) up to point (31) to form armhole line; draw an oblique line ($G2^2$) to connect points (42) and (12) and make a modification on the line to point (11). Then set a point (43) from point (17) at a distance equal to the length between points (17) and (26), and keep the length between points (43) and (26) equal to the distance between points (8) and (42), then draw a line ($I_2$) to connect points (43) and (17) to complete the basic pattern as shown in FIG. 31.

If the shoulder slope is different, use 8.4 cm as a standard size, the size for the described embodiment. In case it exceeds by the standard size, 10.4 cm for example, the horizontal line (D) can be moved slightly downward, 1 cm in the embodiment; if the shoulder slope is smaller than the standard size, 6.4 cm in the embodiment, the horizontal line (D) can be raised of 1 cm in the embodiment.

What is claimed is:

1. A method of preparing a pattern drawing of the upper body tailoring by means of the data obtained from the measure of shoulder depth, arm girth, back width, shoulder width, neck base girth, back length, front length, bust depth, breast depth, bust width, bust breadth, chest girth, breast girth and abdominal depth and by obtaining a front side line, which consists of: first drawing a horizontal line from a free point (1), setting a point (2) rightward along the horizontal line at an arbitrary distance, drawing a vertical line downward from the point (2) for the front side line, setting a point (3) rightward along the horizontal line (1) from point (2) at a distance equal to ¼ of the arm girth+ 4 cm, the distance between points (2) and (3) being equal to the width of armhole, drawing a vertical line downward from point (3); drawing a horizontal line (4) downward from the point (2) or point (3) at a distance equal to ¼ of arm girth+ 14 cm for armhole depth; setting a back shoulder point (5) downward from point (3) at a distance equal to 1/6 of shoulder width and at 1.3 cm leftward from the vertical line of the point (3); setting a front shoulder point (6) downward from point (2) at a distance equal to 4/6 of shoulder width—0.5 cm and at 2.5 cm rightward from the vertical line of the point (2); setting a back armpit point point (7) at 2.5 cm upward from the horizontal line (4) along the vertical line from point (3); drawing a horizontal line rightward from point (7) for back width and setting a point (8) at a distance equal to one-half of back width, the distance between points (7) and (8) being equal to the back width; setting a point (9) rightward along the horizontal line (1) at a distance equal to one-half of the shoulder width from point (5); when the shoulder width point (9) is wider than the back width point (8), drawing a vertical line downward from point (9) for the back central line (10), when the back width point is equal to the shoulder width point, drawing a vertical line through points (9) and (8); when the back width point (8) is wider than the shoulder width point (9), drawing a vertical line through point (8) for the back central line (10); setting a point (11) leftward from the cross point between the horizontal line (1) and the back central line (10) at a distance equal to 1/6 of neck base girth+ 1.3 cm so as to obtain the size for the back collar width; setting a point (12) at 2 cm upward vertically from point (11) so as to obtain the size for the depth of back neck point; setting a point (13) at 0.5 cm downward from the point (12), drawing an oblique line to connect points (5) and (13); drawing a curved line from point (12) of a length of 3 cm to connect with the line between points (5) and (13) at point (14); drawing a horizontal line downward from point (12) at a distance equal to the back length as the back waistline (15); setting a point (16) along the horizontal line (1) left-upper side from the point (6) at a distance equal to the distance between points (5) and (12) for the front neck point, when the shoulder dart is present, deducting the length of the shoulder dart; setting a point (17) for the bust depth downward from point (2) at a distance equal to the bust depth, setting a point (18) for breast depth leftward along a horizontal line from point (17) at a distance equal to the breast depth, when the breast depth protrudes over abdominal depth, drawing a vertical line downward directly from point (18); setting a point (19) downwardly directly from point (2) at a distance equal to front length and drawing a horizontal line for the front waist line, thus obtaining the difference between the front waistline (19) and the back waistline (15); setting a point (20) leftward along horizontal line (1) from point (16) at a distance equal to the back collar width—0.5 cm for the front collar width; setting a bust point (21) rightward along the horizontal line from point (18) at a distance equal to one-half of the bust width; placing a triangle with the short side aimed at point (21) in a length equal to the distance between points (18) and (21) and with the longer side aimed at point (20) drawing a rectangular line by both sides of the triangle to cross at the peak point (22), thus obtaining the expansion of the central bust dart between points (18) and (22); drawing a vertical line upward from point (6) to obtain a cross point ($6^1$) with the horizontal line (1); setting a point (24) from point (16) along the extension line through points (23) and (16) at a distance equal to the size between points (16) and ($6^1$); applying a triangle with the long side aimed at the connecting line between points (16) and (24), setting a point (25) along the short side of the triangle from point (24) at a distance equal to the distance between points ($6^1$) and (6) as a moved shoulder point; drawing a line to connect points (16) and (25); drawing a horizontal line below the horizontal armhole line (4) at a distance equal to the depth between points (1) and (24) so as to obtain a cross point (26) with the vertical front side line (2) for adjustment of the armpit line; setting a front armpit point (27) at 2.5 cm upward along the vertical line from point (26); applying a triangle with the long side aimed at the connecting line between points (20) and (22) and with the short side passing through point (27) so as to obtain a peak point (28); applying a triangle with the longer side aimed at the connecting line between points (20) and (28) and with the short side passing through neck point (16) to obtain a cross point (23) to form an adjusted front shoulder line; drawing a line to connect points (27) and (28) for the bust breast line, setting a point (29) rightward from point (28) along the bust breast line at a distance equal to ½ of the bust breast; setting a point (30) along the horizontal line (4) from the vertical line (2) at a distance equal to ½ of the armhole width and draw a vertical line downward from the point (30), setting a point (31) leftward from the point (26) at a distance equal to the distance between points (27) and (29); drawing a vertical line to temporarily separate front and back side line; setting a point (32) for the depth of front collar opening downward from point (23) along the connecting line between points (23) and (22) at a distance equal to 2 cm+ the length between points (16) and (23); drawing a line to connect points (5), (14) and (12) for the back shoulder width, to draw a curved line from point (12) to cut with the horizontal line (1) and to extend to the back central line (10), for the collar opening; drawing a curved line from point (5) to cut with vertical lines (3), (7) and horizontal line (4), up to the point (30) for the back armhole, combining with the back central line (10), vertical side line (30) and back waistline (15) to form a basic pattern for the back part of the upper body; connecting points (16) and (25) for the front shoulder length, drawing a curved line to connect points (16) and (32) for the collar opening, drawing a curved line from point (25) through point (29) to cut with the horizontal line (31) for the front armhole; drawing a straight line to connect points (32) and (22), a straight line to connect points (22) and (21), a straight line to connect points (21) and (18) so as to leave a blank space between points (18) and (22) for bust dart, from the front central line (18) downward from the side vertical line (31) downward and the front waistline (19) to form a basic pattern for the front part of the upper body, then combining the front part pattern and the back part pattern at respective side line point (30) and (31) along the vertical lines to complete the pattern for the upper body.

2. The method according to claim 1 wherein the abdominal depth protrudes beyond the breast depth, a point (33) is set at 10 cm downward along the vertical line from the front waist line (19) and a horizontal line (33) is drawn for the abdominal level; a point (34) is set leftward along the abdominal level from point (33) at a distance equal to the abdominal depth; a triangle is applied with the short side aimed at the bust point (21) of a length equal to ½ of the bust width and with the long side of the triangle passing through point (34) so as to obtain a peak point (35) at the right angle to form a correcting angle; wherein the space between points (22) and (35) is for natural bust dart.

3. The method according to claim 1 wherein the bust dart is adjusted by means of the use of sun-ray lines, wherein the size (A) between points (10) and (22), and the size (A'), between points (35) and (22) in the body figure where abdominal depth protrudes beyond breast depth and lines b, c, d, e, f, g, h, i, j, k, l are for combination of basic bust dart (A) or (A') to shirt the proper line, the top points of front side line and back side line are directed together, the difference in size at the bottom can be left at original place or be shifted to the sun-ray lines, and when it is left in the original place, 2 cm is the maximum size, and the excessive part should be distributed to said sun-ray lines.

4. The method according to claim 3 wherein the shoulder slope is different from the standard, 8.4 cm being the standard size, and the shoulder slope varies from the standard size by 10.5 cm, the horizontal line (D) is moved downward of about 1 cm and when the shoulder slope is smaller than the standard size by 6.4 cm, the horizontal line (D) is raised by about 1 cm.

5. The method according to claim 1 wherein when the width of the shoulder blade is greater than the width between the two shoulder points which consists of setting a point (38) downward from point (11) at a distance of 10 cm equal to the size from back neck point to the shoulder blade level, drawing a horizontal line to cross with the vertical line ($F^2$) at point (39), then setting a point (40) leftward along the horizontal line from point (39) at a distance equal to one-half the width between both left and right armhole lines, said width being measured at a level 10 cm below back neck point around the shoulder blade of 18.5 cm; setting a point (41) at the center of the distance between points (8) and (11); applying a triangle with one side aimed at points (8) and (40), and with another side aimed at point (41), drawing oblique lines ($G1^2$) and ($P2^2$) to cross at point (42); drawing a curved line from the point (42) downward along oblique lines ($P2^2$) through point (40) up to point (31) to form armhole line; drawing an oblique line ($G2^2$) to connect points (42) and (12) and make a modification on the line to point (11); setting a point (43) from point (17) at a distance equal to the size between points (17) and (26), keeping the size between points (43) and (26) equal to the distance between points (8) and (42), then drawing a line (I2) to connect points (43) and (17).

* * * * *